US006349665B1

(12) United States Patent
Taylor, Jr.

(10) Patent No.: US 6,349,665 B1
(45) Date of Patent: Feb. 26, 2002

(54) DRONE VESSEL FOR AN ROV

(75) Inventor: Leland Harris Taylor, Jr., Houston, TX (US)

(73) Assignee: Mentor Subsea Technology Services, Inc., Houston, TX (US)

( * ) Notice: Subject to any disclaimer, the term of this patent is extended or adjusted under 35 U.S.C. 154(b) by 0 days.

(21) Appl. No.: 09/638,321

(22) Filed: Aug. 14, 2000

(51) Int. Cl.[7] ..... B63G 8/00; B63G 8/04

(52) U.S. Cl. ..... 114/312; 114/259; 114/331; 114/338; 114/339

(58) Field of Search ..... 114/312, 313, 114/321, 330, 331, 337, 338, 339, 77 R, 259

(56) References Cited

U.S. PATENT DOCUMENTS 1,997,149 A * 4/1935 Lake
4,721,055 A * 1/1988 Pado
6,148,759 A * 11/2000 Taylor, Jr.
6,167,831 B1 * 1/2001 Watt et al. ..... 114/322

* cited by examiner

*Primary Examiner*—Sherman Basinger
(74) *Attorney, Agent, or Firm*—D. Neil LaHaye; R. C. Baraona; Eric Marich

(57) ABSTRACT

A drone vessel for an ROV. The drone vessel utilizes dynamic positioning. The drone vessel is remotely controlled by radio telemetry, preferably modular in construction, and may be semi-submersible. The vessel contains a radio telemetry package, one or more generators, an umbilical winch for lowering and raising an ROV, space for receiving and storing an ROV, and ballast control. The central compartment in the drone vessel is free flooding and houses the drum for storing umbilical line and the winch for paying out umbilical line to the ROV. The central compartment also includes space for the ROV.

4 Claims, 8 Drawing Sheets

DRONE VESSEL FOR AN ROV

BACKGROUND OF THE INVENTION

1. Field of the Invention

The invention is generally related to the use of a remotely operated vehicle (ROV) or robotic tooling for underwater work and more particularly to the means used for launching, controlling, and recovering an ROV or tooling package.

2. General Background

Many underwater operations, such as drilling for and production of oil and gas, installation and maintenance of offshore structures, or laying and maintaining underwater pipelines require the use of a remotely operated vehicle (ROV) or robotic tooling.

The deployment of an ROV is typically achieved by launching the unit from either a bottom founded or floating host platform, a dynamically positioned marine vessel dedicated specifically for the purpose of supporting an ROV, e.g. an ROV support vessel (RSV), or any such surface vessel with sufficient size and characteristics that provide a suitably stable platform for the launching and recovery of an ROV.

Both bottom founded and floating host platforms are fixed in position at the site and are normally engaged in collateral activities such as drilling and offshore production or construction. Thus, the operations of the ROV are limited according to the distance that the ROV can travel from the host platform as well as by restrictions in operating periods due to the collateral activities of the host platform.

In the case of dedicated vessel deployment such as an RSV, significant costs are associated with operation of a fully founded marine vessel and its mobilization to and from the ROV work site. Typically, a dedicated RSV may have a crew of twenty and a considerable cost not directly related to the operation of the ROV.

ROV operation and monitoring is controlled from the host platform or RSV by means of an umbilical line between the host platform or RSV and the ROV. It can be seen from this that the operational distance of the ROV is directly related to the length of the umbilical line.

A remotely operated near surface drone vessel with adequate stability that is capable of launching, controlling, and recovering an ROV eliminates the limitations associated with operation from a fixed host platform and reduces the expense associated with a manned, dedicated RSV.

The remotely operated drone vessel requires an umbilical line, storage drum, and winch to launch, control, and recover the ROV. The drone vessel must have certain compartments that are dedicated to electronic control equipment that must remain dry. Locating the winch and storage drum for the umbilical line in a dry compartment requires a seal that the umbilical line must pass through. Failure of the seal would allow water into the compartment, which would cause damage to any equipment in the compartment. A sealed compartment also adds buoyancy, which requires additional ballast, thereby increasing the mass and possibly the size of the vessel, which is undesirable.

Storage of the umbilical in a dry compartment requires a large volume of variable ballast in order to maintain a constant operating draft. The dispensing of the umbilical from a dry compartment and suspending into the sea will result in an increase in the displacement of the combined vessel, umbilical system. This change in displacement will not occur when using a flooded umbilical compartment. The use of large volumes of variable ballast is undesirable as it increases the operation complexity, the mass, and the size of the vessel. It can be seen that water displacement and ballast are not adequately addressed in the present art.

SUMMARY OF THE INVENTION

The invention addresses the above needs. What is provided is a drone vessel for an ROV. The drone vessel utilizes dynamic positioning. The drone vessel is remotely controlled by radio telemetry, preferably modular in construction, and may be semi-submersible. The vessel contains a radio telemetry package, one or more generators, an umbilical winch for lowering and raising an ROV, space for receiving and storing an ROV, and ballast control. The central compartment in the drone vessel is free flooding and houses the drum for storing umbilical line and the winch for paying out umbilical line to the ROV. The center section, winch, or ballast may be movable in order to improve the vessel stability when stationary or maneuvering at low speeds. The central compartment also includes space for the ROV.

BRIEF DESCRIPTION OF THE DRAWINGS

For a further understanding of the nature and objects of the present invention reference should be made to the following description, taken in conjunction with the accompanying drawing in which like parts are given like reference numerals, and wherein.

DETAILED DESCRIPTION OF THE PREFERRED EMBODIMENT

Figure 1:
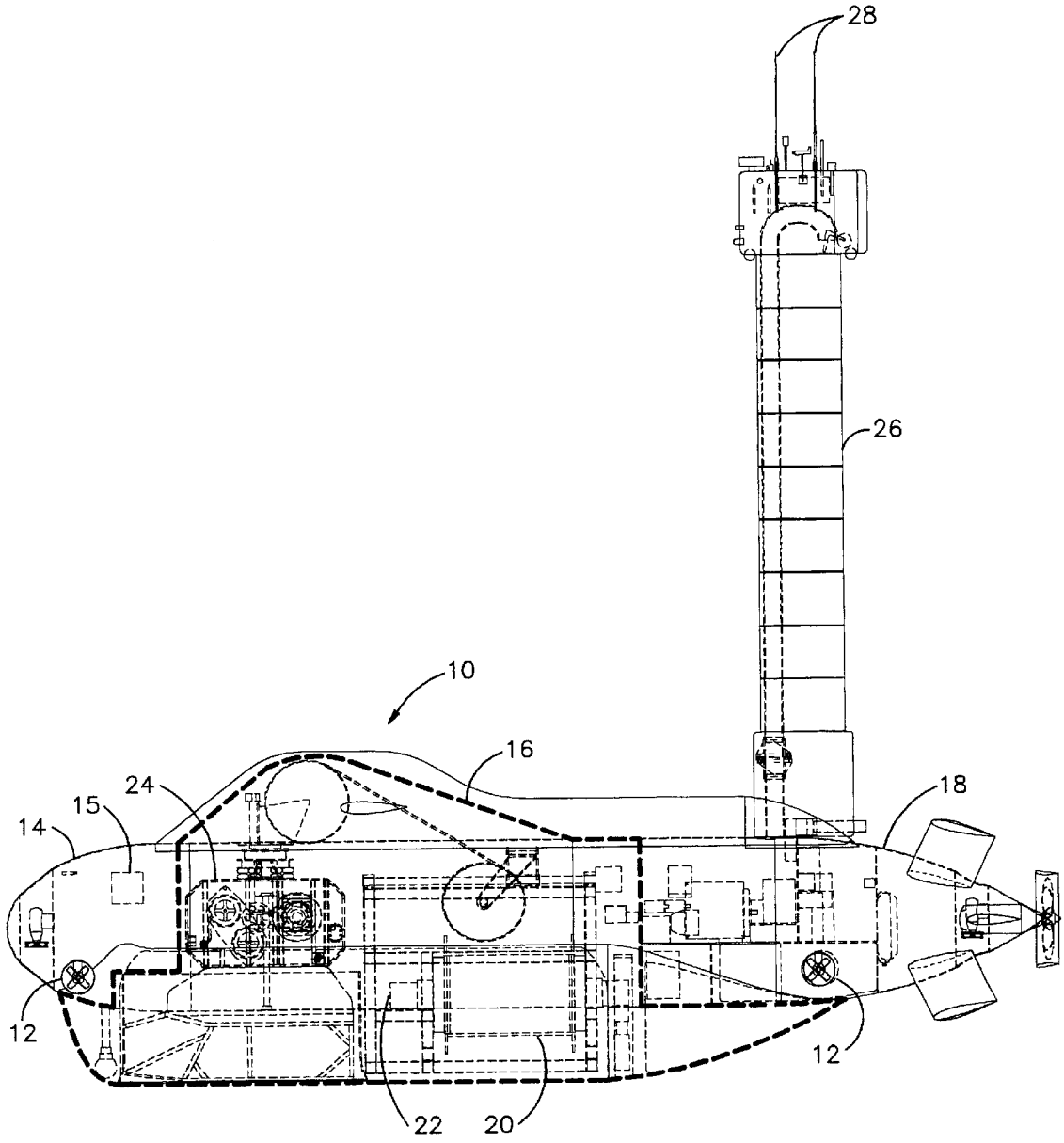
FIG. 1 is a side section view of the invention.

Referring to the drawings, it is seen in FIG. 1 that the invention is generally indicated by the numeral 10. Drone vessel 10 is a buoyant vessel that utilizes a plurality of dynamic positioning thrusters 12, one illustrated at each corner.

Vessel 10 is preferably modular in construction to facilitate trucking, air transport, ease of handling offshore, and exchange of components for ease of maintenance and repair. Each modular component houses one or more vessel subsystems. A typical configuration is described below.

Separate modules 14, 16, and 18 are provided. The modules are rigidly attached to each other. Any suitable type of ballast control means generally known in the art may be used for controlling the draft of the vessel 10 to provide the necessary stability for environmental conditions.

The first module 14 is self-buoyant and may house any suitable subsystems such as one or more generators 15 for powering equipment in the drone vessel 10.

The second module 16, which forms the center section, is free flooding and houses a storage drum 20 for umbilical line and a winch 22. The second module 16 also includes a space for storing the ROV 24. Umbilical winches are generally known in the art and contain slip rings not shown to allow communication between the umbilical line revolving on the winch and the ROV surface control package. The winch 22 is powered by generator 15 and is used to power as well as raise and lower the ROV 24. Other equipment that may be exposed to seawater, such as lead ballast, sensors, fuel bladder, and a hydroacoustic device, can also be located in this module.

The third module 18 is self-buoyant and may house any suitable subsystems such as video cameras, signal handling means, transmitters, and other electronic equipment.

A mast 26 attached to the top of the third module 18 extends upward and includes one or more radio telemetry antennas 28. The top of the mat 26 remains above the water line during operations to maintain radio contact with the host platform or RSV. The mast 26 contains duct work that provides engine air intake and exhaust to the surface from the third module.

Making the second module a free flooding compartment provides several advantages. The possibility of a failed seal around the umbilical line is eliminated. Locating the winch and drum in a free flooded compartment reduces buoyancy effects (less displaced water) and reduces the amount of dead weight necessary.

Figure 2:
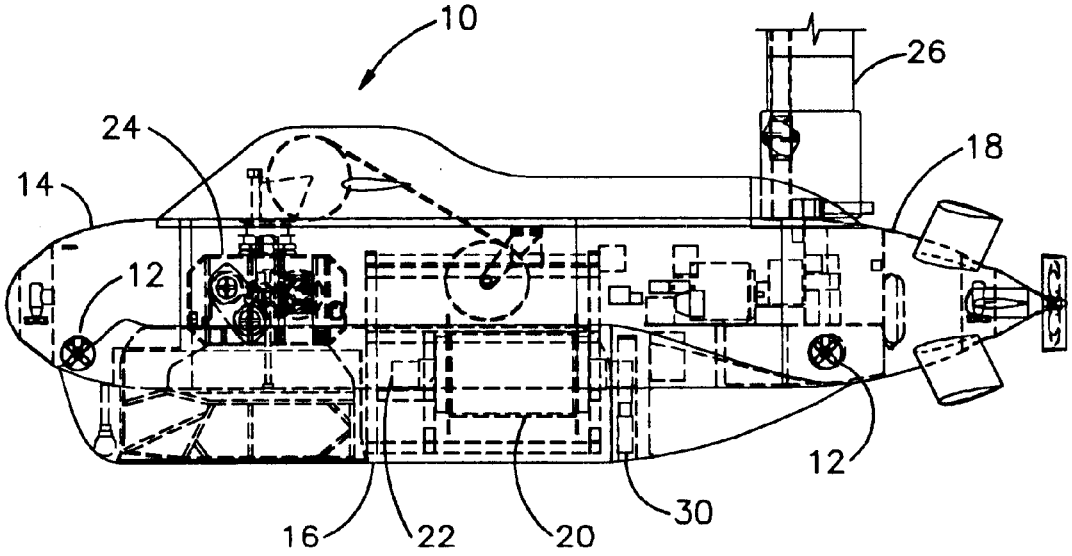
FIG. 2 is a side section view of an alternate embodiment of the invention with movable ballast.
Figure 3:
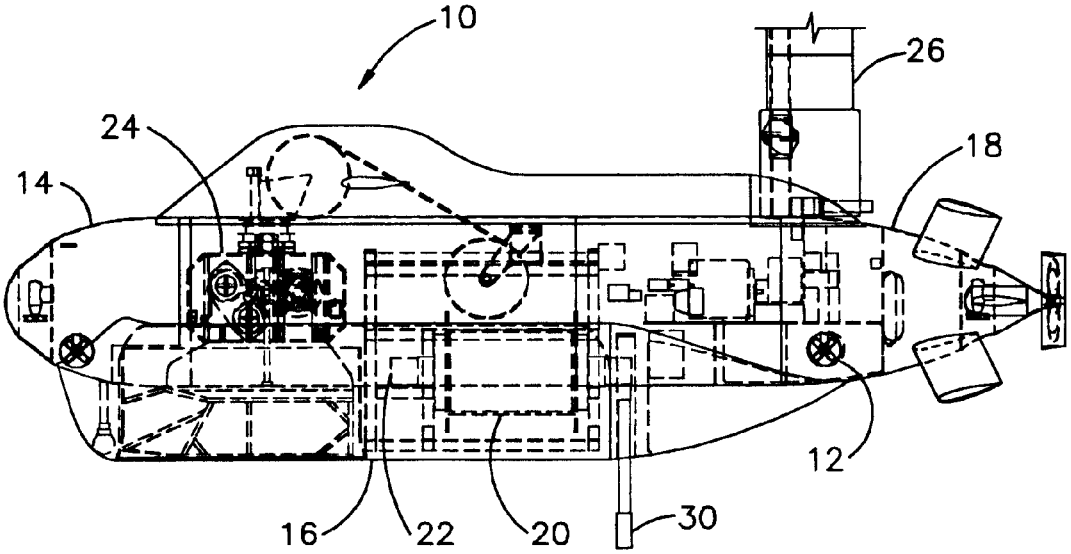
FIG. 3 is a side section view of the alternate embodiment of FIG. 2 with the ballast at a lowered position.

FIGS. 2 and 3 illustrate an alternate embodiment of the drone vessel 10 wherein the ballast material 30 is movable between a first upper position and a second lower position. FIG. 2 illustrates the ballast material 30 is in the first upper position. FIG. 3 illustrates the ballast material 30 in the second lower position. Any suitable ballast material such as lead may be used. The ballast material 30 may be designed to move on rails, in guides, or on a rod by mechanical means.

Figure 4:
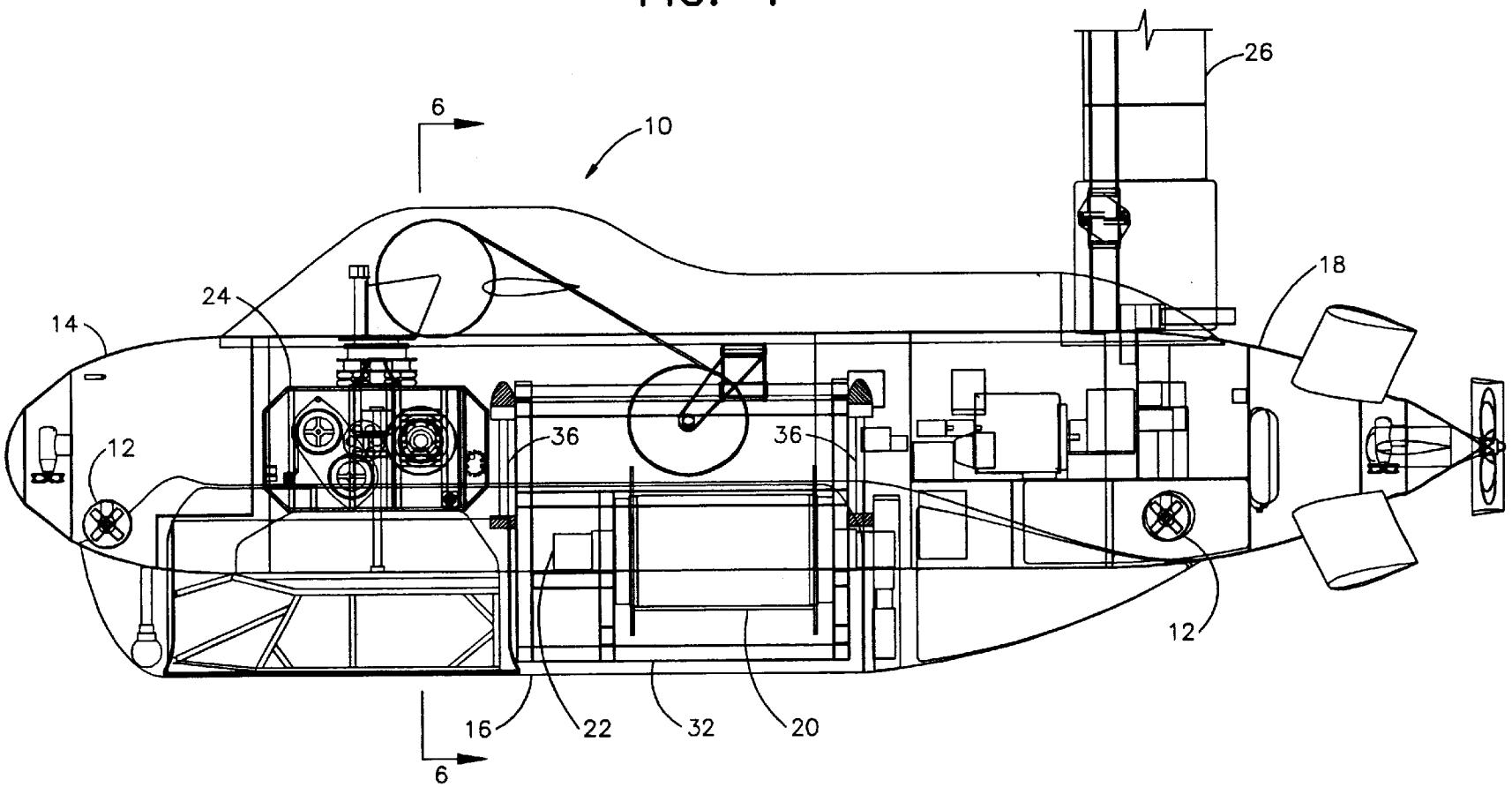
FIG. 4 is a side section view of an alternate embodiment of the invention with a movable winch and storage drum.
Figure 5:
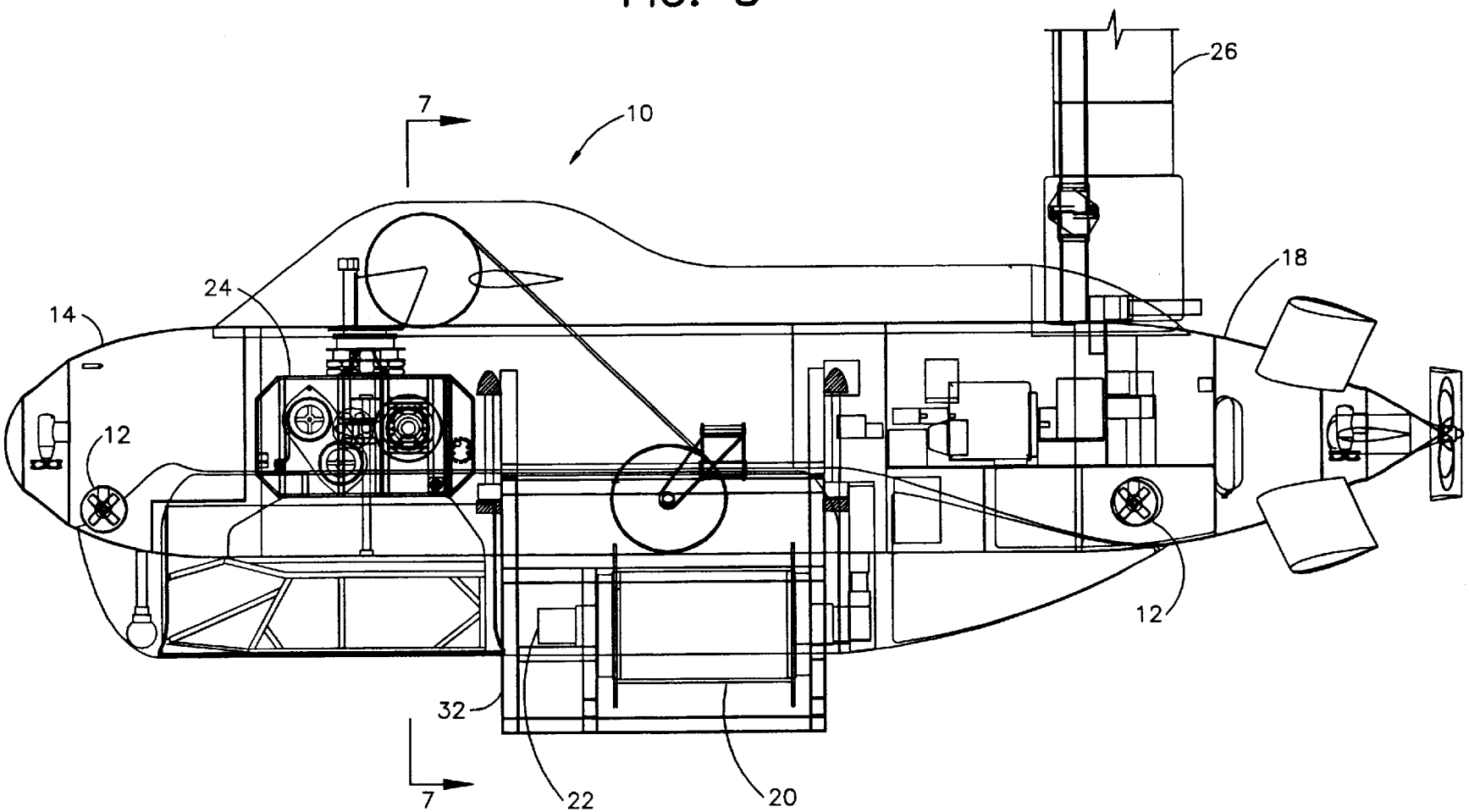
FIG. 5 is a side section view of the alternate embodiment of FIG. 4 with the winch and storage drum at a lowered position.
Figure 7:
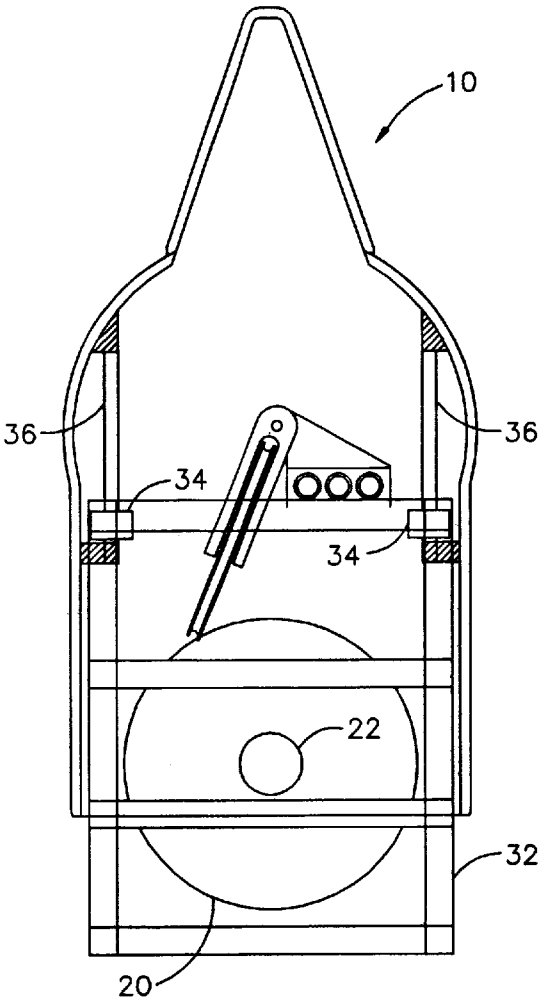
FIG. 7 is a view taken along lines 7—7 in FIG. 5.
Figure 6:
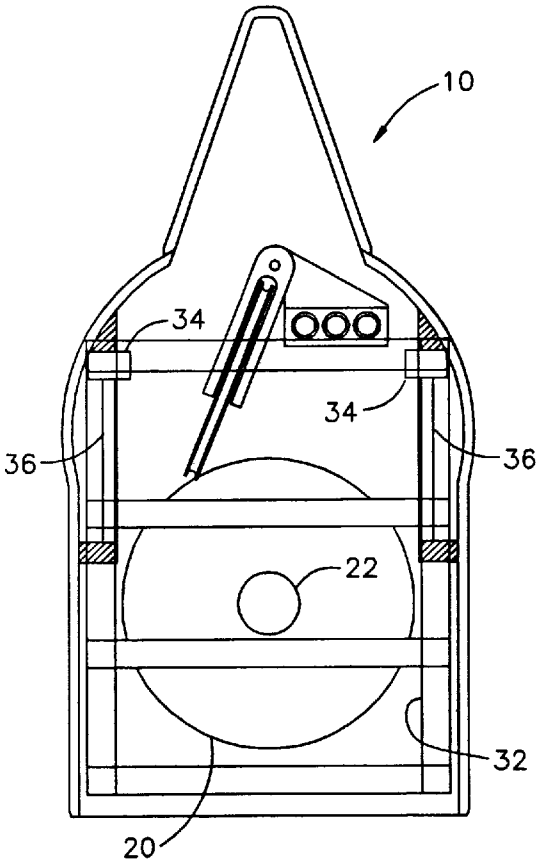
FIG. 6 is a view taken along lines 6—6 in FIG. 4.

FIGS. 4–7 illustrate another alternate embodiment of the drone vessel 10 wherein the storage drum 20 and winch 22 are movable between a first upper position and a second lower position. FIGS. 4 and 6 illustrate the storage drum 20 and winch 22 in the first upper position. FIGS. 5 and 7 illustrate the storage drum 20 and winch 22 in the second lower position. The storage drum 20 and winch 22 are mounted on a frame 32. The frame 32 is provided with a plurality of jacking screws 34 that are operatively engaged with threaded rods 36 mounted in the second module 16. The rods 36 are rotated in the desired direction to move the frame 32 up or down as desired. The weight of the storage drum 20 and winch 22 are used as adjustable ballast to stabilize the drone vessel 10.

Figure 8:
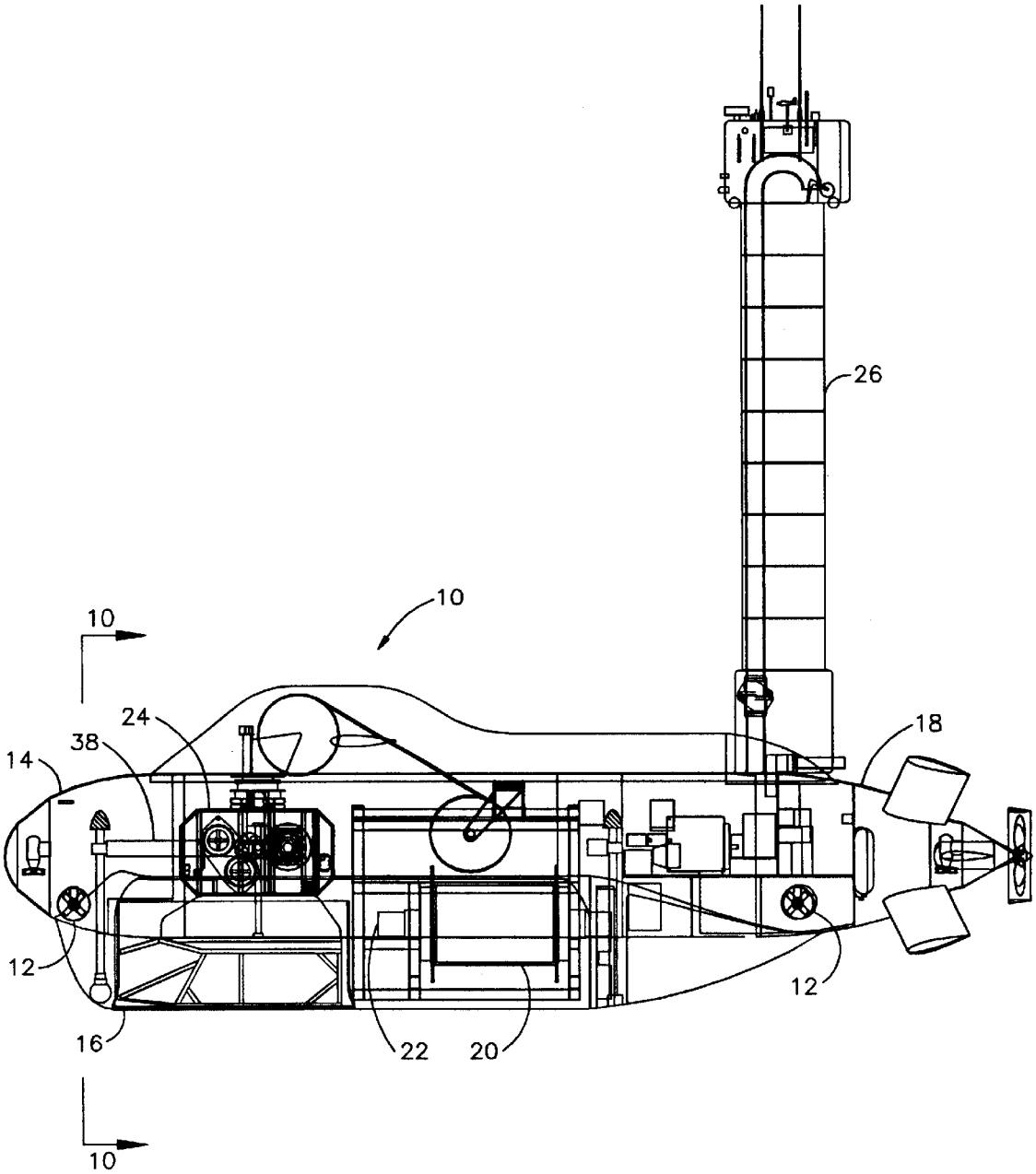
FIG. 8 is a side section view of an alternate embodiment of the invention with a movable frame that supports the ROV, winch, and storage drum.
Figure 9:
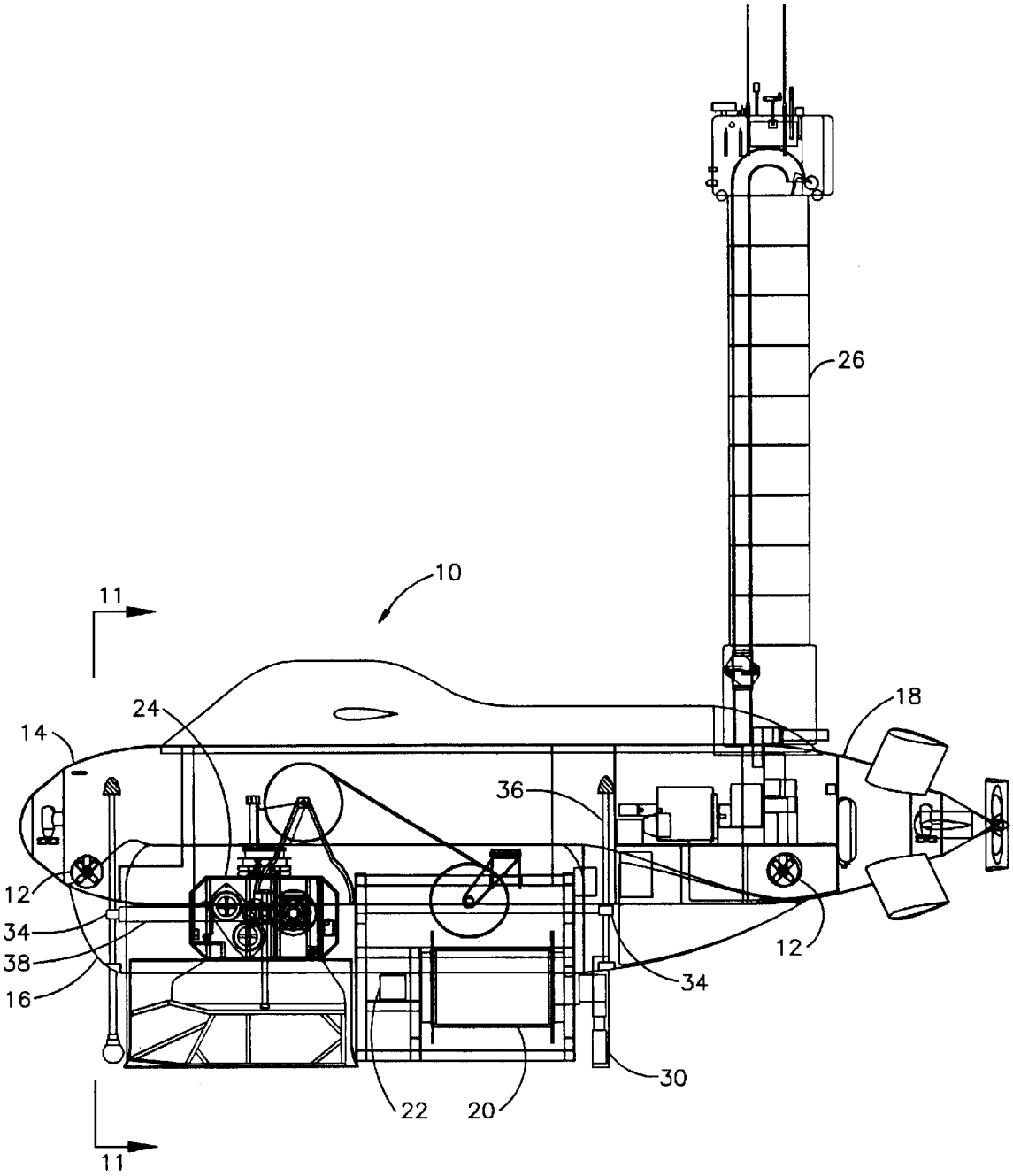
FIG. 9 is a side section view of the alternate embodiment of FIG. 8 with the frame at a lowered position.
Figure 10:
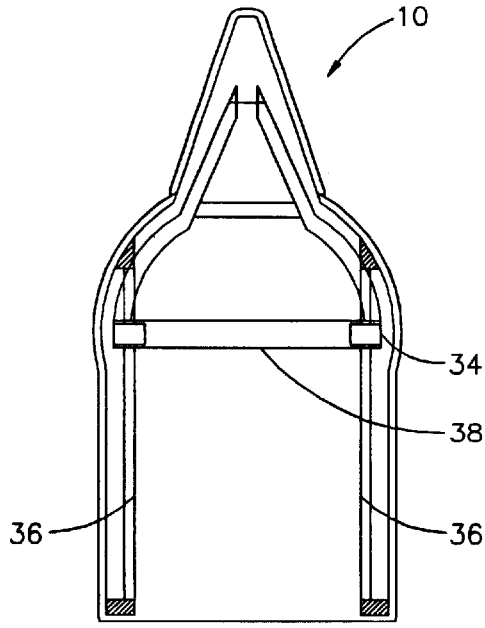
FIG. 10 is a view taken along lines 10—10 in FIG. 8.
Figure 11:
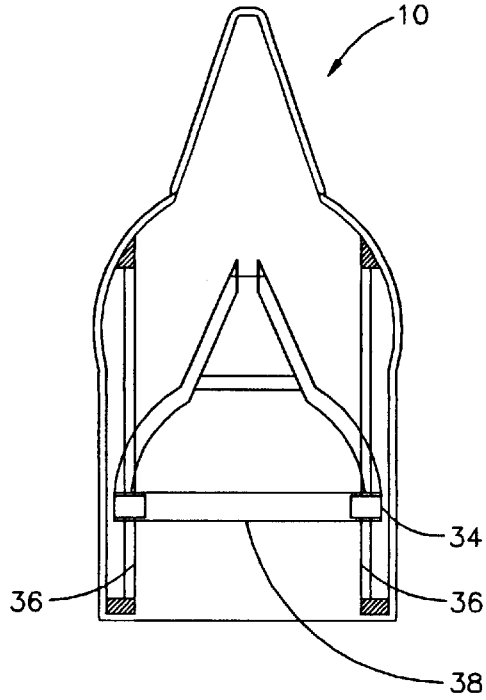
FIG. 11 is a view taken along lines 11—11 in FIG. 9.

FIGS. 8–11 illustrate another alternate embodiment of the drone vessel 10 wherein the equipment housed in the second module 16 is movable between a first upper position and a second lower position. FIGS. 8 and 10 illustrate the equipment in the first upper position. FIGS. 9 and 11 illustrate the equipment in the second lower position. The ROV, storage drum 20, and winch 22 in the second module are supported by a frame 38. The frame 38 is provided with a plurality of jacking screws 34 that are operatively engaged with threaded rods 36 mounted in the second module 16. The rods 36 are rotated in the desired direction to move the frame 38 up or down as desired. The weight of the ROV 24, storage drum 20, and winch 22 are used as adjustable ballast to stabilize the drone vessel 10.

Although the components are described above as being installed in a specific module, it should be understood that this is for descriptive purposes only and that any suitable arrangement may be utilized.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A self-propelled, semi-submersible drone vessel for an ROV, comprising:

a. a first module, said first module being self buoyant;

b. a second free flooding module attached to said first module;

c. a winch and storage drum located in said second module;

d. a third module attached to said second module, said third module being self buoyant;

e. dynamic positioning thrusters provided on said first and third modules;

f. means mounted in said first module for powering equipment mounted on said drone vessel; and g. a mast attached to the vessel, said mast extending upwards from the vessel and including a radio telemetry antenna, with the top of said mast remaining above the water line during operations.

2. A drone vessel for an ROV, comprising:

a. a first module, said first module being self buoyant;

b. a second free flooding module attached to said first module;

c. a winch and storage drum provided in said second module;

d. ballast material provided in said second module, said ballast material being movable between a first upper position and a second lower position;

e. a third module attached to said second module, said third module being self buoyant; and f. dynamic positioning thrusters provided on said first and third modules.

3. A drone vessel for an ROV, comprising:

a. a first module, said first module being self buoyant;

b. a second free flooding module attached to said first module;

c. a winch and storage drum located in said second module, said winch and storage drum being selectively movable between a first upper position and a second lower position;

d. a third module attached to said second module, said third module being self buoyant; and e. dynamic positioning thruster provided on said first and third modules.

4. A drone vessel for an ROV, comprising:

a. a first module, said first module being self buoyant;

b. a second free flooding module attached to said first module;

c. a frame located in said second module for supporting the ROV, a winch, and a storage drum said frame being movable between a first upper position and a second lower position;

d. a third module attached to said second module, said third module being self buoyant; and e. dynamic positioning thrusters provided on said first and third modules.

* * * * *